US007543532B2

(12) United States Patent
Nance

(10) Patent No.: US 7,543,532 B2
(45) Date of Patent: Jun. 9, 2009

(54) FULL FUNCTION INITIATOR WITH INTEGRATED PLANAR SWITCH

(75) Inventor: Christopher J Nance, Middletown, CA (US)

(73) Assignee: Reynolds Systems, Inc., Middletown, CA (US)

( * ) Notice: Subject to any disclaimer, the term of this patent is extended or adjusted under 35 U.S.C. 154(b) by 420 days.

(21) Appl. No.: 11/430,944

(22) Filed: May 9, 2006

(65) Prior Publication Data

US 2007/0261583 A1 Nov. 15, 2007

(51) Int. Cl.
*F42C 11/00* (2006.01)
*F42C 19/12* (2006.01)
*F42B 3/14* (2006.01)

(52) U.S. Cl. ..... 102/202.8; 102/202.5; 102/202.9; 361/247

(58) Field of Classification Search ..... 102/202.5, 102/202.7, 202.8, 202.9, 206, 218; 361/248, 361/251

See application file for complete search history.

(56) References Cited

U.S. PATENT DOCUMENTS 4,096,541 A * 6/1978 Bohin et al. ..... 361/120
4,840,122 A * 6/1989 Nerheim ..... 102/202.5
4,891,730 A * 1/1990 Saddow et al. ..... 361/111
4,935,666 A * 6/1990 McCann ..... 313/595
5,216,325 A * 6/1993 Patel et al. ..... 313/595
5,444,598 A 8/1995 Aresco
5,600,293 A 2/1997 Hunter
5,641,935 A 6/1997 Hunter et al.
6,158,347 A * 12/2000 Neyer et al. ..... 102/202.7
6,178,888 B1 * 1/2001 Neyer et al. ..... 102/202.7
6,851,370 B2 2/2005 Reynolds et al.
6,923,122 B2 8/2005 Hennings et al.
6,977,468 B1 * 12/2005 Baginski ..... 313/602
2002/0079030 A1 6/2002 Chan et al.
2007/0261583 A1 * 11/2007 Nance ..... 102/202.8
2007/0261584 A1 * 11/2007 Nance et al. ..... 102/202.8
2008/0134921 A1 * 6/2008 Nance ..... 102/202.5
2008/0148982 A1 * 6/2008 Hennings et al. ..... 102/202.7

* cited by examiner

*Primary Examiner*—James S Bergin
(74) *Attorney, Agent, or Firm*—Harness, Dickey & Pierce, P.L.C.

(57) ABSTRACT

A switch device having a base, a first electrically conductive pad coupled to the base, a second electrically conductive pad coupled to the base, a first electrically conductive projection and a second electrically conductive projection. The second electrically conductive pad is spaced apart from the first electrically conductive pad by a first predetermined distance. The first electrically conductive projection is coupled to the first electrically conductive pad and extends into the first gap. The second electrically conductive projection is coupled to the second electrically conductive pad and extends into the first gap. The second electrically conductive projection is spaced apart from the first electrically conductive projection by a second predetermined distance. The first and second electrically conductive projections form an electrical interface.

15 Claims, 5 Drawing Sheets

FULL FUNCTION INITIATOR WITH INTEGRATED PLANAR SWITCH

CROSS-REFERENCE TO RELATED APPLICATIONS

Other aspects of the present disclosure are claimed in co-pending U.S. patent application Ser. No. 11/431,111, filed on even date herewith entitled "Full Function Initiator With Integrated Planar Switch".

INTRODUCTION

The present disclosure generally relates to detonators and initiation firesets for initiating a detonation event in an explosive charge and more particularly to a detonator with an exploding foil initiator having multiple triggering mode functionality.

Exploding foil initiators, which are also known as slappers, are employed to generate a shock wave to initiate a detonation event in an explosive charge. In a conventionally designed exploding foil initiator, a bridge is connected to a power source through two relatively wide conductive lands or pads. In a system wherein operation of the exploding foil initiator is initiated by an external trigger (i.e., standard mode operation), the power source can typically be a capacitor whose discharge is governed by a high voltage switch. When the switch closes, the capacitor provides sufficient electric current to convert the bridge from a solid state to a plasma. The pressure of the plasma drives a flyer or pellet into contact with the explosive charge, thereby generating the shock wave and initiating the detonation event.

Other modes for operating a detonator with an exploding foil initiator include a breakdown mode and a trigger mode. The breakdown mode entails the use of a conductive pad that is spaced apart from a first electrical conductor that is coupled to the bridge. If a sufficiently large electric potential is applied to the conductive pad and the first electrical conductor, electrical energy will jump the gap between the conductive pad and the first electrical conductor to thereby supply electrical energy to the bridge.

The trigger mode is similar to the breakdown mode, except that a second electrical conductor, which is coupled to a side of the bridge opposite the first electrical conductor, is selectively coupled to a negative voltage source to increase the electric potential between the conductive pad and the first electrical conductor to thereby cause electrical energy to jump the gap between the conductive pad and the first electrical conductor.

Heretofore, it was not desirable to manufacture a detonator with an exploding foil initiator that was operable in all three modes of operation as the added functionality included a commensurate increase in the size and weight of the detonator. Size and weight are important characteristics as it is often times desirable that the device in which the detonator is employed be as small in size and light in weight as possible. Complicating matters, the devices in which the detonators are employed are usually expensive and can be placed in storage for extended periods of time. As such, applicable regulations often mandate the ability to non-destructively verify the integrity of the detonator during construction of the detonator and at times after the device is assembled. The capability to non-destructively test the integrity of the detonator includes the use of various electric leads to permit various components to be tested. For example, the bridge may undergo an electrical continuity test. Consequently, it was thought that a multi-mode detonator would be undesirably larger not only to accommodate the additional functionality but also to incorporate the additional leads that were needed to satisfy the requirement for periodic verification of the integrity of the detonator.

Accordingly, there remains a need in the art for an improved detonator with an exploding foil initiator having multi-mode operational capabilities.

SUMMARY

In one form the present teachings provide switch device having a base, a first electrically conductive pad coupled to the base, a second electrically conductive pad coupled to the base, a first electrically conductive projection and a second electrically conductive projection. The second electrically conductive pad is spaced apart from the first electrically conductive pad by a first predetermined distance. The first electrically conductive projection is coupled to the first electrically conductive pad and extends into the first gap. The second electrically conductive projection is coupled to the second electrically conductive pad and extends into the first gap. The second electrically conductive projection is spaced apart from the first electrically conductive projection by a second predetermined distance. The first and second electrically conductive projections form an electrical interface.

In another form, the present teachings provide a device for initiating an energetic material. The device can include an initiator and a switch. The initiator has a base, an element pad and an initiating element. The element pad is coupled to the base and electrically coupled to the initiating element. The element pad has a first projection. The switch has a first switch pad, which is coupled to the base, and a second projection. The element pad and the first switch pad are separated by a gap. The first and second projections extend into the gap. The initiating element is adapted to be activated by electrical energy that is transmitted across the gap.

In yet another form, the present teachings provide method that includes: providing a switch apparatus having first and second electrically conductive pads and first and second electrically conductive projections, the second electrically conductive pad being spaced apart from the first electrically conductive pad by a first gap of a first predetermined distance, the first electrically conductive projection coupled to the first electrically conductive pad and extending into the first gap, the second electrically conductive projection coupled to the second electrically conductive pad and extending into the first gap, the second electrically conductive projection being spaced apart from the first electrically conductive projection by a second predetermined distance; and applying electrical energy to at least one of the first and second electrically conductive pads to cause at least a portion of the electrical energy to be transmitted between the first and second electrically conductive projections.

Further areas of applicability of the present disclosure will become apparent from the detailed description provided hereinafter. It should be understood that the detailed description and specific examples, while indicating a particular embodiment of the disclosure, are intended for purposes of illustration only and are not intended to limit the scope of the disclosure.

BRIEF DESCRIPTION OF THE DRAWINGS

Additional advantages and features of the present disclosure will become apparent from the subsequent description and the appended claims, taken in conjunction with the accompanying drawings, wherein:

DETAILED DESCRIPTION OF THE VARIOUS EMBODIMENTS

Figure 1:
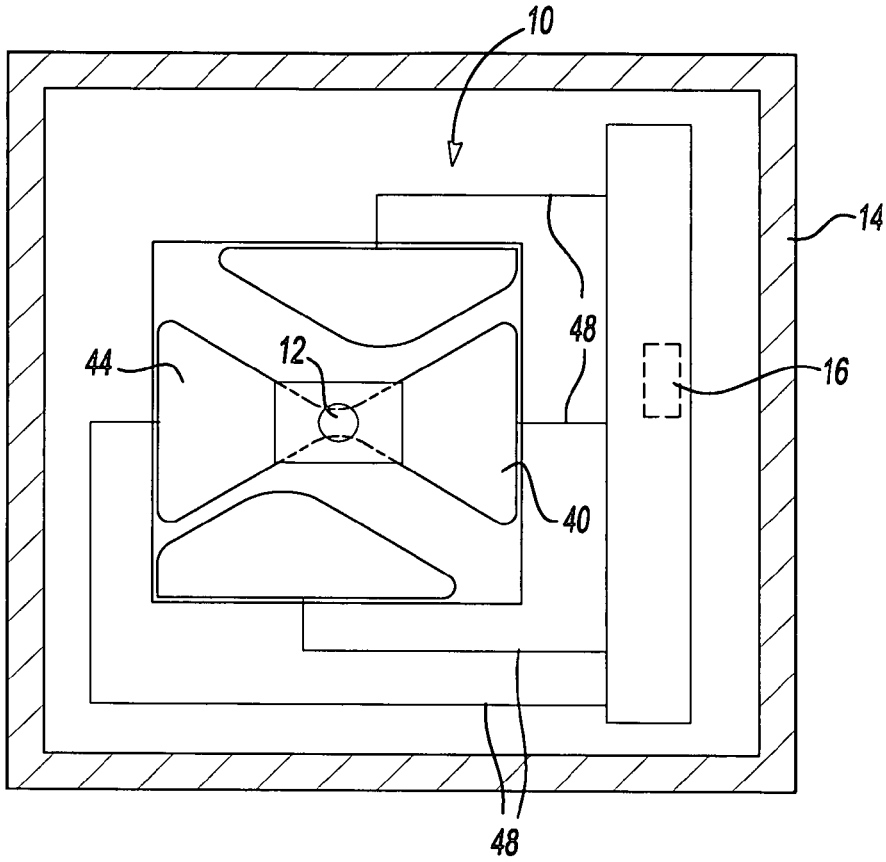
FIG. 1 is a schematic plan view of a detonator constructed in accordance with the teachings of the present disclosure.
Figure 2:
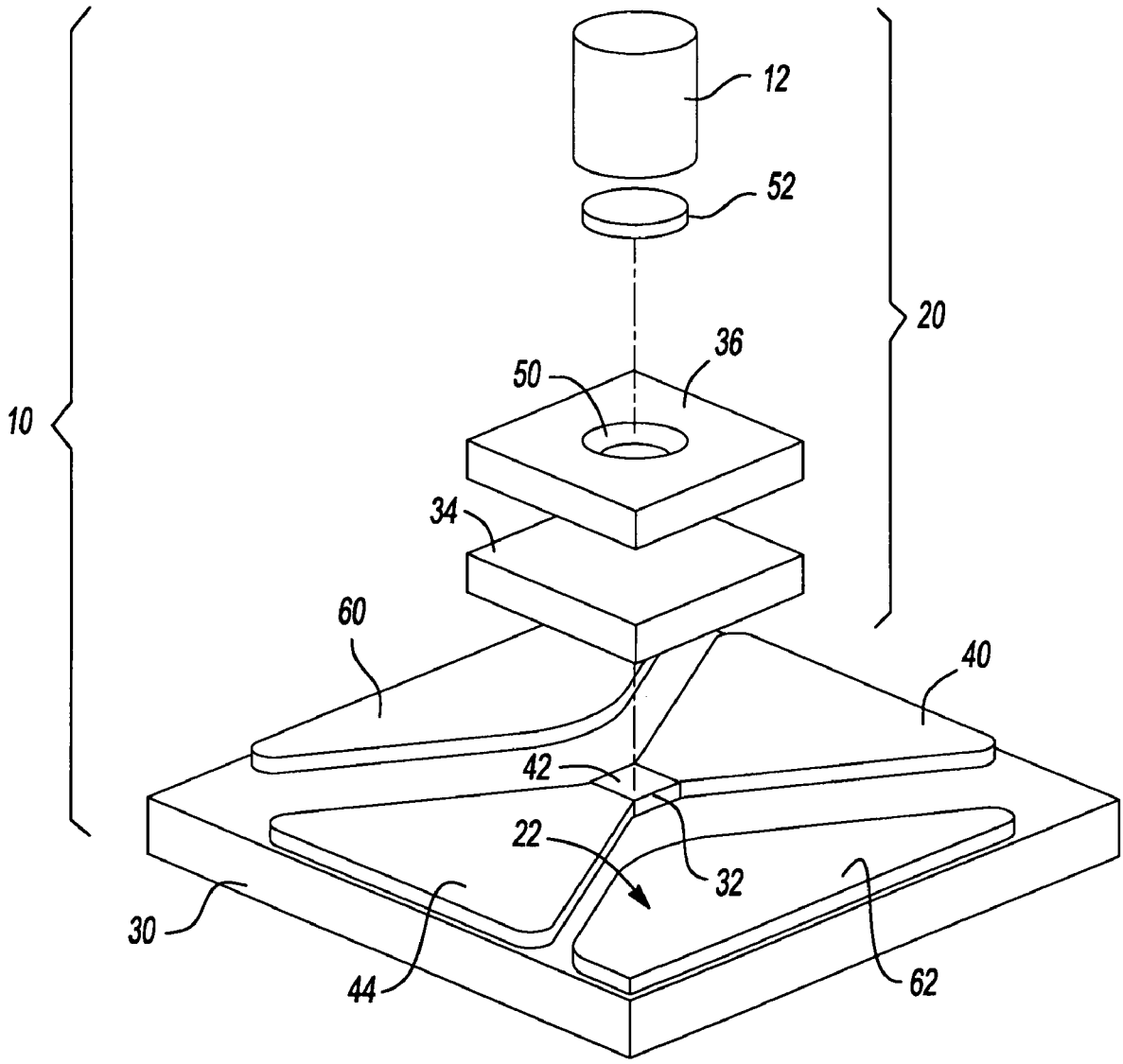
FIG. 2 is an exploded perspective view of a portion of the detonator of FIG. 1 illustrating the initiator in more detail.

With reference to FIGS. 1 and 2 of the drawings, a detonator constructed in accordance with the teachings of the present disclosure is generally indicated by reference numeral 10. The detonator 10 is employed to initiate a detonation event in an explosive charge 12. The explosive charge 12 can be a secondary explosive material, such as pentaerythritol tetranitrate (PETN), cyclotrimethylenetrinitramine (RDX), trinitrotoluene (TNT) or hexanitro stilbene (HNS), but may alternatively can be a primary explosive, such as mercury fulminate, lead styphnate or lead azide. The detonator 10 can be disposed in a sealed housing 14 and can be operatively associated with a source of electrical energy 16 as will be discussed in greater detail, below. The housing 14 can be sealed, for example with a hermetic seal, so that both the detonator 10 and the explosive charge 12 are impervious to moisture, dirt, contaminants or changes in atmospheric pressure or composition, which may detrimentally effect their operation. The source of electrical energy 16 can be any appropriate source of electrical energy, such as a capacitor or a battery. While the source of electrical energy 16 is illustrated to be disposed inside the sealed housing 14, it will be appreciated that the source of electrical energy 16 may be located in any appropriate location inside or outside the housing 14.

The detonator 10 can include an exploding foil initiator 20 and an integrated planar switch 22. The exploding foil initiator 20 can include a base 30, a detonator bridge 32, a flyer layer 34 and a barrel layer 36. The base 30 can be formed from an electrically insulating material, such as ceramic, glass, polyimide or silicon.

The detonator bridge 32, which can be unitarily formed from a suitable electric conductor, such as copper, gold, silver and/or alloys thereof, and can be fixedly coupled to or formed onto the base 30 in an appropriate manner, such as chemical or mechanical bonding or metallization. The detonator bridge 32 can include a base layer of copper or nickel that is covered by an outer layer of gold. The detonator bridge 32 can include a first bridge pad 40, a bridge 42, and a second bridge pad 44, all of which are electrically coupled to one another. The first bridge pad 40 can serve as an electrical terminal that permits the detonator bridge 32 to be coupled to the source of electrical energy 16 through one or more bond wires 48. The bridge 42 can be disposed between the first bridge pad 40 and the second bridge pad 44 and can be necked down relative to the remainder of the detonator bridge 32 so as to promote its transition from a solid state to a gaseous or plasma state when an electric current that exceeds a threshold current flows through the detonator bridge 32.

The flyer layer 34 can be formed from a suitable electrically insulating material, such as polyimide or parylene, and can overlie a portion of the detonator bridge 32 that includes the bridge 42. The barrel layer 36, which can be formed of an electrically insulating material, such as a polyimide film, can be bonded to the base 30 to maintain the flyer layer 34 in a juxtaposed relation with the detonator bridge 32 and the barrel layer 36. A barrel aperture 50 can be formed in the barrel layer 36 in an area that is situated directly above and in-line with the bridge 42 and can provide a route by which a sheared pellet or flyer 52 may impact the explosive charge 12 and initiate the detonation event.

Figure 3:
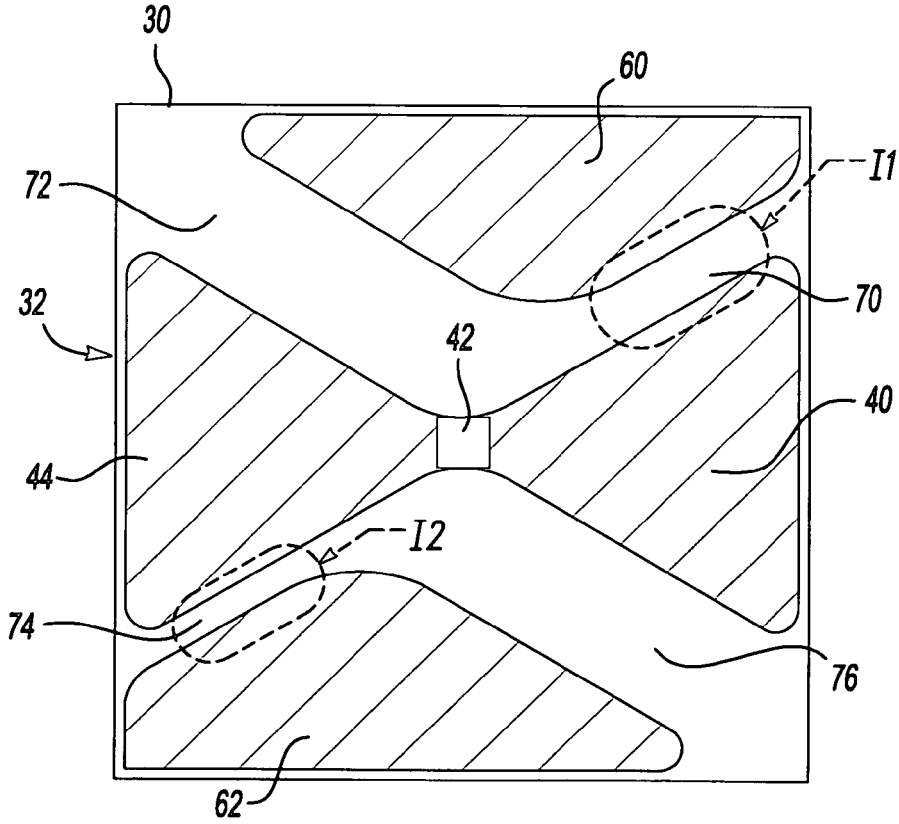
FIG. 3 is a plan view of a portion of the detonator of FIG. 1, illustrating the base, the detonator bridge and the switch of the initiator in more detail.

With reference to FIGS. 2 and 3, the switch 22 can include a source pad 60 and a return pad 62. In the particular example provided, the source pad 60, the first and second bridge pads 40 and 44 and the return pad 62 are generally triangular in shape (i.e., have inwardly tapering sides that terminate at or about an apex) so as to conserve space to thereby reduce the size of the detonator 10, but those of ordinary skill in the art will appreciate that one or more of the pads can be shaped differently.

The source pad 60 and the return pad 62 can be unitarily formed from a suitable electric conductor, such as copper, gold, silver and/or alloys thereof, and can be fixedly coupled to or formed onto the base 30 in an appropriate manner, such as chemical or mechanical bonding or metallization. The source pad 60 and the return pad 62 can be positioned to form various gaps between respective ones of the first and second bridge pads 40 and 44. The source pad 60, for example, which can be disposed between the first and second bridge pads 40 and 44, can be offset toward the first bridge pad 40 so that a shortest distance between the source pad 60 and the first bridge pad 40 (i.e., a first gap distance across a first gap 70) is smaller than a shortest distance between the source pad 60 and the second bridge pad 44 (i.e., a second gap distance across a second gap 72). An interface 11 is formed between the source pad 60 and first bridge pad 40 that can facilitate the transmission of electrical energy as will be described in detail, below. As the adjacent sides of the source pad 60 and the first bridge pad 40 are generally parallel in this example, the shortest distance of the illustrated embodiment is measured along a line that is perpendicular to the adjacent sides and the interface I1 is relatively long. In the example provided, the first gap distance is about 0.012 inch (0.30 mm).

Similarly, the adjacent sides of the source pad 60 and the second bridge pad 44 are generally parallel in the example provided and thus the shortest distance is measured along a line that is perpendicular to the adjacent sides. In the example provided, the second gap distance is about 0.030 inch (0.76 mm).

The return pad 62, which can be disposed between the first and second bridge pads 40 and 44 on a side opposite the source pad 60 can be offset toward the second bridge pad 44 so that a shortest distance between the second bridge pad 44 and the return pad (i.e., a third gap distance across a third gap 74) is smaller than a shortest distance between the first bridge pad 40 and the return pad 62 (i.e., a fourth gap distance across a fourth gap 76). An interface I2 is formed between the return pad 62 and second bridge pad 44 that can facilitate the transmission of electrical energy as will be described in detail, below. As the adjacent sides of the second bridge pad are generally parallel in the example provided, the shortest distance can be measured along a line that is generally perpendicular thereto. Consequently, the interface I2 is also relatively long. In the particular embodiment shown, the third gap distance is about 0.006 inch (0.15 mm).

Similarly, the adjacent sides of the first bridge pad 40 and the return pad 62 are generally parallel in the example provided and as such, the shortest distance is measured along a line that is generally perpendicular thereto. In the particular embodiment provided, the fourth gap distance is about 0.030 inch (0.70 mm).

Thus constructed, the detonator 10 may be operated in several different ways. For example, standard mode operation may be obtained through use of an external device (i.e., external to the detonator 10) that is capable of switching a source of electrical energy with a relatively high voltage to function the exploding foil initiator 20. In this mode, electrical energy can be applied directly across the first and second bridge pads 40 and 44.

As another example, the detonator 10 may be operated in a breakdown mode wherein a breakdown voltage can be applied to the source pad 60 to activate the detonator 10. In this mode, current does not pass through the bridge 42 until the voltage that is applied to the source pad 60 exceeds that which is needed to cause electrical energy to flow through the first interface I1 (e.g., a spark to "jump" the first gap 70 that is disposed between the source pad 60 and the first bridge pad 40). In the particular example provided, no bias voltage is applied to the first or second bridge pads 40 and 44 or to the return pad 62 and the return pad 62 can be coupled to an electrical ground so that electrical energy passing through the bridge 42 will jump the third gap 74 that is disposed between the second bridge pad 44 and the return pad 62. It will be appreciated, however, that the second bridge pad 44 could be coupled to an electrical ground in the alternative so that the electrical energy will not have to jump the third gap. Those of ordinary skill in the art will appreciate from this disclosure that the breakdown voltage may be applied to the return pad 62 rather than to the source pad 60 and that either the first bridge pad 40 or the source pad 60 could be coupled to an electrical ground.

As yet a further example, the detonator 10 may be operated in a trigger mode wherein voltage that is less than the breakdown voltage is applied to the source pad 60 and a negative biasing voltage is selectively applied to the first bridge pad 40, the second bridge pad 44 and/or the return pad 62. As the voltage that is applied to the source pad 60 is less than the breakdown voltage, the exploding foil initiator 20 will not operate. When the negative biasing voltage is selectively applied, the electric potential between the source pad 60 and the first bridge pad 40 will increase to a point that permits electrical energy to flow through the first interface I1 (e.g., permits a spark to jump the first gap 70) and thereby initiate the flow of electric current through the bridge 42. Those of ordinary skill in the art will appreciate from this disclosure that the voltage may be applied to the return pad 62 rather than to the source pad 60 and that the biasing voltage may be selectively applied to the first bridge pad 40, the second bridge pad 44 and/or the source pad 60. In such case, the application of the negative biasing voltage will cause the electric potential between the return pad 62 and the second bridge pad 44 to increase to a point that permits electrical energy to flow through the second interface I2 to thereby initiate the flow of electric current through the bridge 42.

It will be appreciated that the biasing voltage may be applied to a side of the exploding foil initiator 20 on a side of the bridge 42 opposite the side on which the relatively high voltage is applied (e.g., to the second bridge pad 44 or to the return pad 62 if high voltage is applied to the source pad 60), so that more energy will flow through the bridge 42 when the detonator 10 is operated as compared to a prior art detonator. As such, the working range and reliability of the detonator 10 is improved relative to prior art detonators.

It will also be appreciated that the reliability and operational integrity of the exploding foil initiator 20 may be verified through a relatively smaller number of contacts relative to prior art detonators. In this regard, the relatively large sizes of the first and second bridge pads 40 and 44 may be employed to directly check the resistance of the bridge 42. Moreover, the two contacts (e.g., an electric trace that is disposed between the bridge and a source pad) that are employed for the trigger in a prior art detonator are not needed in view of the above teachings. As such, the detonator 10 not only provides increased functionality (i.e., the capability of being selectively operated in the standard, breakdown and trigger modes), but employs relatively fewer leads or contacts on the exploding foil initiator 20 and permits the exploding foil initiator 20 to be packaged in a relatively smaller area.

While the example provided herein has been directed to a detonator that employs an exploding foil initiator, those of ordinary skill in the art will appreciate that the disclosure, in its broadest aspects, may be constructed somewhat differently. In this regard, the teachings of the present disclosure are applicable to both initiators and detonators that employ a high voltage firing system.

Figure 4:
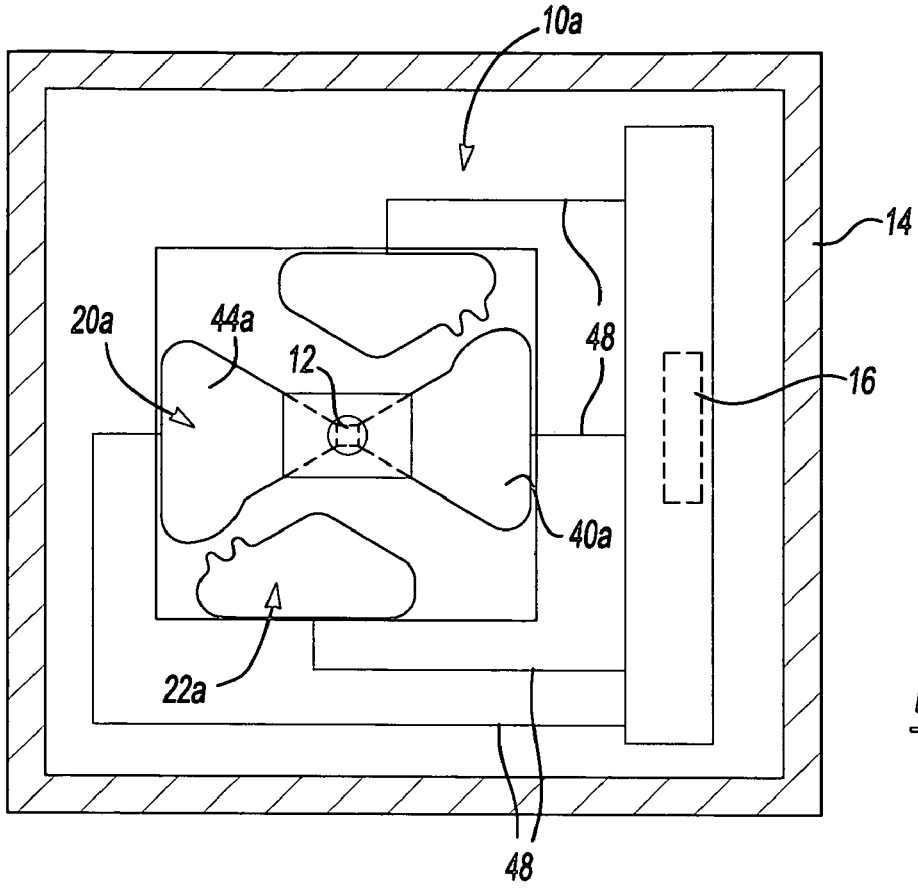
FIG. 4 is a schematic plan view of another detonator constructed in accordance with the teachings of the present disclosure.

In the example of FIG. 4, a detonator 10*a* is illustrated as including an exploding foil initiator 20*a* and an integrated planar switch 22*a* that are constructed in accordance with the teachings of the present disclosure. As the detonator 10*a* can be otherwise identical to the detonator 10 illustrated in FIG. 1 and described in detail, above, a detailed discussion of the remainder of the detonator 10*a* need not be provided herein.

Figure 5:
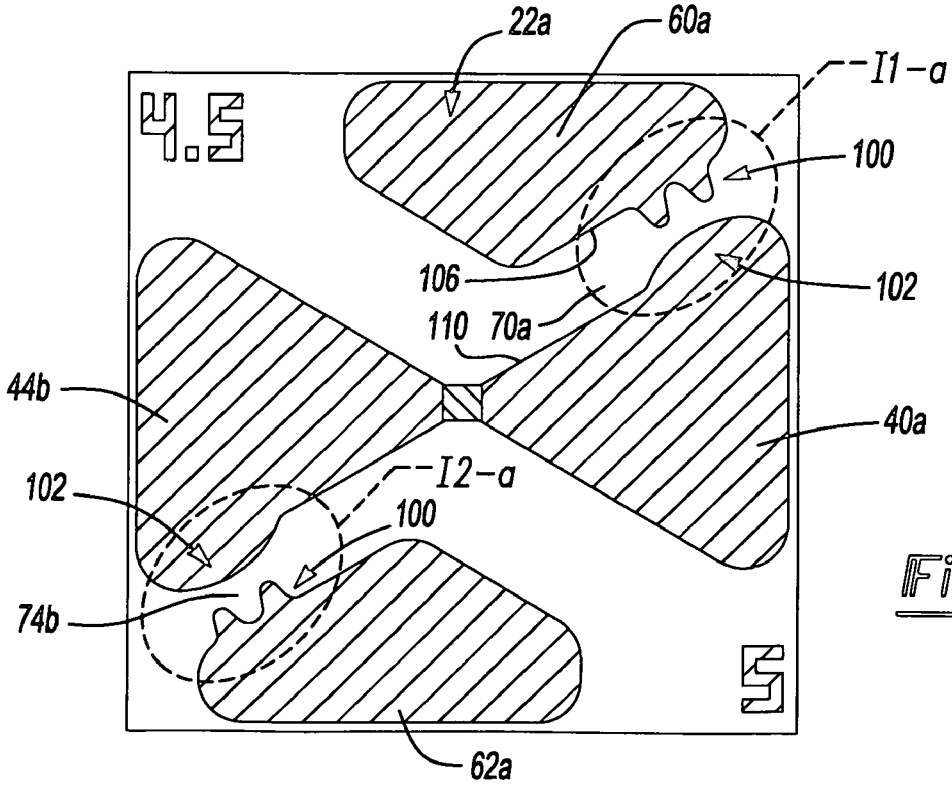
FIG. 5 is a plan view of a portion of the detonator of FIG. 4, illustrating the base, the detonator bridge and the switch of the initiator in more detail.

With additional reference to FIG. 5, the construction of the exploding foil initiator 20*a* and the switch 22*a* is generally similar to the construction of the exploding foil initiator 20 and the switch 22 (FIG. 2) described above except for the configuration of the first and second interfaces I1-*a* and I2-*a*, respectively. More specifically, the first and second interfaces I1-*a* and I2-*a* can be configured to transmit electrical energy in a relatively small zone as compared to the configurations that are associated with the example of FIGS. 1 through 3.

Figure 6:
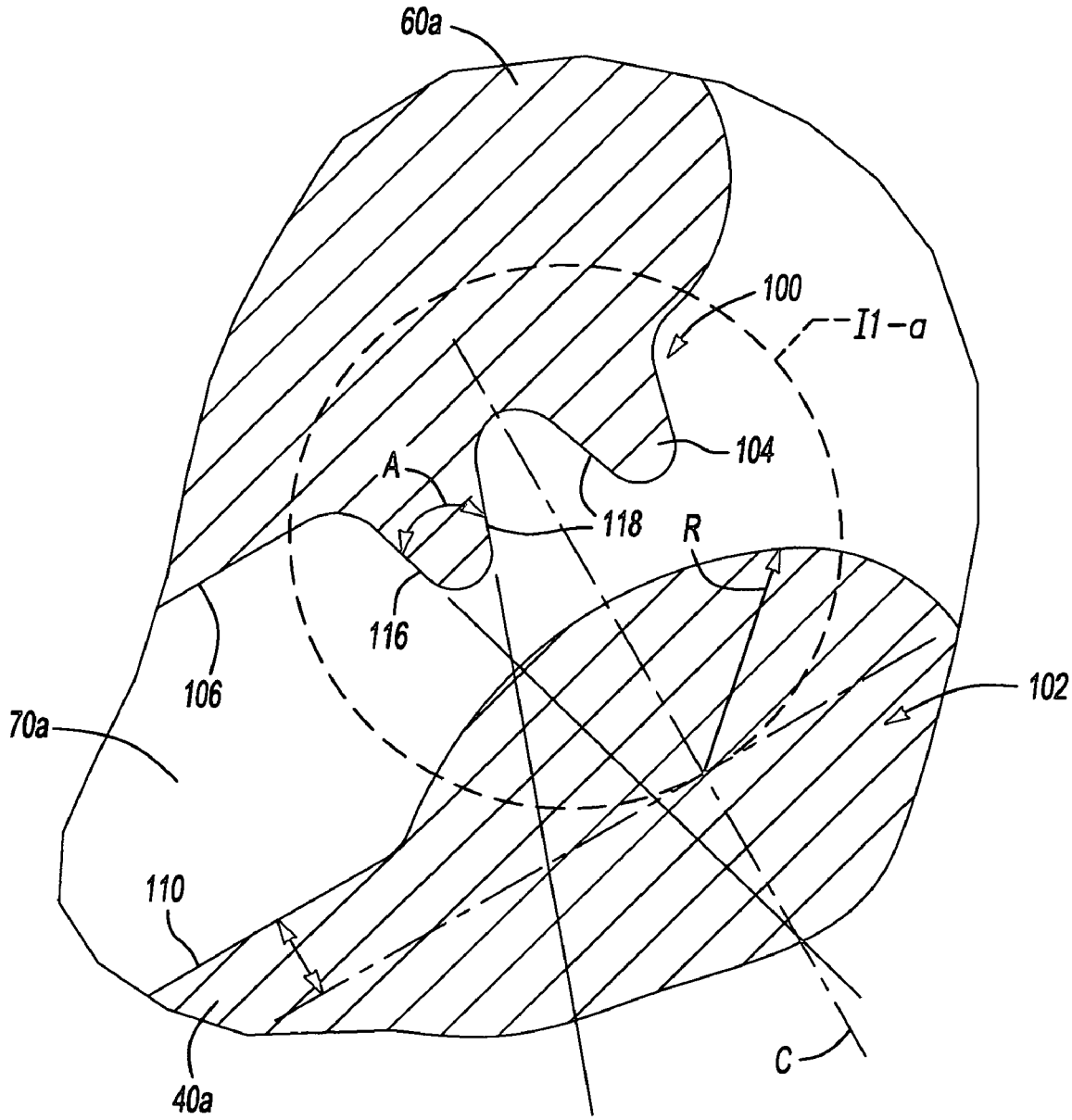
FIG. 6 is an enlarged portion of FIG. 5.

In the particular example provided, the interfaces I1-*a* and I2-*a* are identical and as such, only the interface I1-*a* will be discussed in detail. It will be appreciated, however, that the two interfaces could be configured differently from one another. With reference to FIGS. 5 and 6, the interface I1-*a* can include a first projection 100, which can be formed by the source pad 60*a*, and a second projection 102, which can be formed by the first bridge pad 40*a*. The first projection 100 can include a plurality of tooth-like members 104 that extend from the sidewall 106 of the source pad 60*a* into the first gap 70*a*, while the second projection 102 can be a semi-circular segment that extends from the sidewall 110 of the first bridge pad 40 into the first gap 70*a*. Preferably, the tooth-like members 104 are equidistant from the second projection 102. In the particular example provided:

- the distance between the sidewalls 106 and 110 can be about 0.018 inch;
- the radius R that defines the semi-circular segment can be disposed from the sidewall 110 by a distance d, which can be about 0.018 inch;
- the radius R that defines the semi-circular segment can be about 0.024 inch;
- each tooth-like member 104 can be disposed about a centerline C of the radius R;

the interior angle A of the tip 116 of each tooth-like member 104 can be about 30° to about 40°, and preferably about 35.7°;

the interior edge 118 of the tooth-like member 104 can be disposed at an angle of about 15° to about 25° from the centerline C, and preferably about 20° from the centerline C; and a radius, such as a radius of about 0.002 inch, can be employed to terminate the edges that define the tip 116 of the tooth-like member 104.

It will be appreciated by those of ordinary skill in the art that the geometry of the first and second projections 100 and 102 (e.g., size, shape, location) may be varied from that which is shown depending on various factors, including the size of the gap 70*a* and the magnitude of the electric potential that is to be applied to the interface I1-*a*. The radius R that defines the semi-circular segment can be relatively larger than the radius that is employed to terminate the tip 116 of the tooth-like member 104. For example, the radius R can be greater than or equal to about five (5) times the radius that is employed to terminate the tip 116 of the tooth-like member 104.

Like the detonator 10 (FIG. 1), the detonator 10*a* (FIG. 4) may be operated in several different modes including a first breakdown mode, in which a positive potential is applied to the source pad 60*a* to activate the detonator 10*a*, a second breakdown mode, in which a positive potential is applied to the return pad 62*a* to activate the detonator 10*a* (FIG. 4), and a standard mode in which a source of electrical energy with a relatively high electric potential is applied directly across the first and second bridge pads 40*a* and 44*b*. It will be appreciated that the size of the gaps 70*a* and 74*a* and the geometry of the first and second interfaces I1-*a* and I2-*a* may be tailored such that the first breakdown mode may be associated with a breakdown voltage that is different (e.g., smaller) than the breakdown voltage that is associated with the second breakdown mode.

The detonator 10*a* (FIG. 4) of the present example was found to have a standard deviation in break-over voltage (i.e., the magnitude of the electric potential that is applied to the detonator 10*a*, e.g., across the source pad 60*a* and the first bridge pad 40*a*) of about a third of that of the exemplary detonator 10 of FIGS. 1 through 3. This reduction is significant as it permits operation in a breakdown mode at a voltage that is both highly repeatable from detonator to detonator. Consequently, the power source that provides the electrical energy need not be oversized to the extent that is presently necessary.

Figure 7:
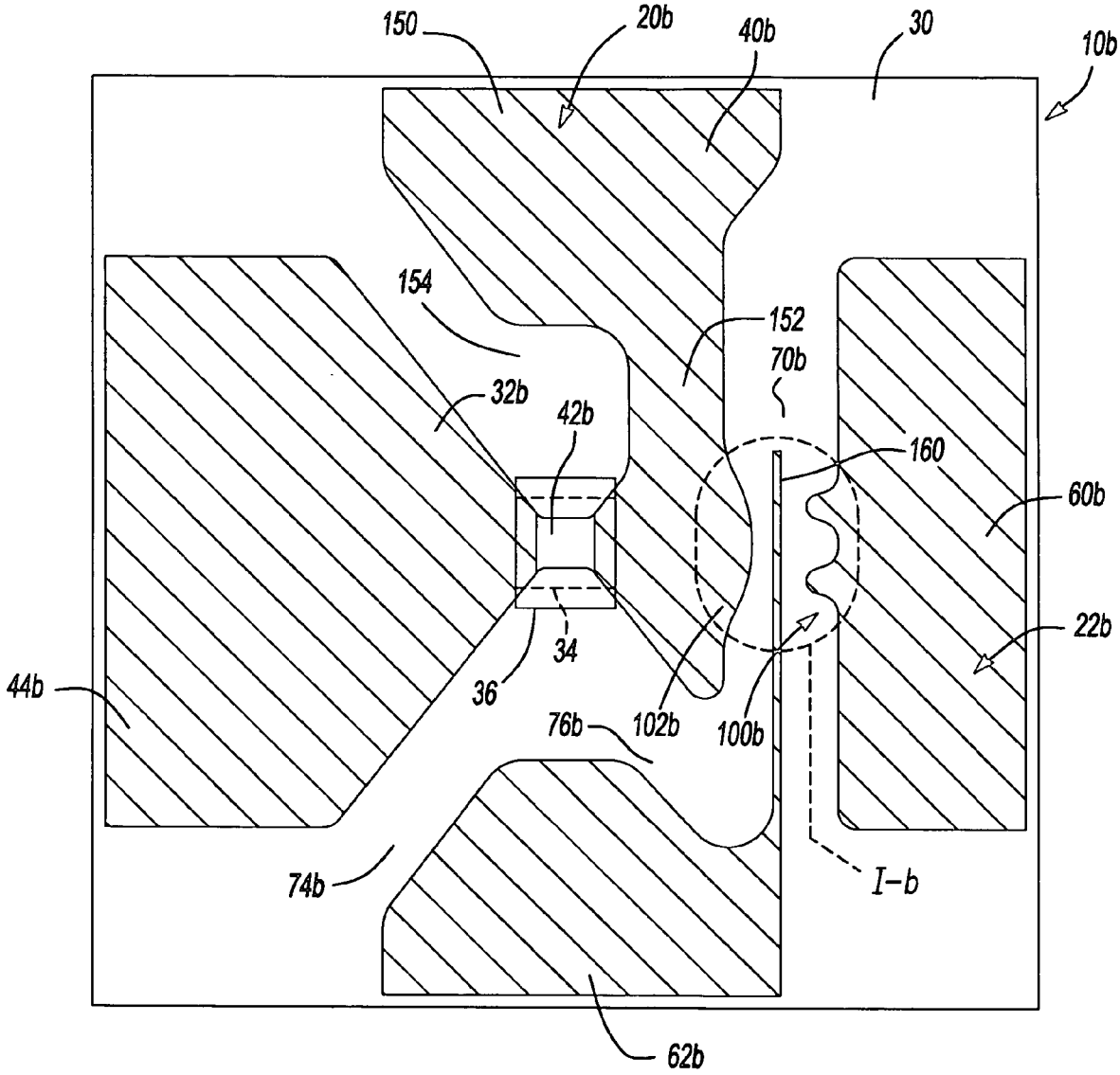
FIG. 7 is a partial view of yet another detonator constructed in accordance with the teachings of the present invention.

In the example of FIG. 7, a third detonator 10*b* constructed in accordance with the teachings of the present disclosure is partially illustrated. The detonator 10*b* includes an exploding foil initiator 20*b* and a switch 22*b*. Like the exploding foil initiator 20 of FIG. 1, the exploding foil initiator 20*a* can include a base 30, a detonator bridge 32*b*, a flyer layer 34 and a barrel layer 36. The base 30, the flyer layer 34 and the barrel layer 36 can be generally similar to those that are associated with the exploding foil initiator 20 discussed above and as such, these components need not be discussed in significant detail herein.

The detonator bridge 32*b*, which can be unitarily formed from a suitable electric conductor, such as copper, gold, silver and/or alloys thereof, and can be fixedly coupled to or formed onto the base 30 in an appropriate manner, such as chemical or mechanical bonding or metallization. The detonator bridge 32*b* can include a base layer of copper or nickel that is covered by an outer layer of gold. The detonator bridge 32*b* can include a first bridge pad 40*b*, a bridge 42*b*, and a second bridge pad 44*b*, all of which are electrically coupled to one another.

In the particular example provided, the first bridge pad 40*b* can be somewhat L-shaped with a base portion 150, which can serve as an electrical terminal that permits the detonator bridge 32*b* to be coupled to the source of electrical energy (not shown) through one or more bond wires (not shown), and a leg portion 152 that is coupled to a first end of the bridge 42*b*. The leg portion 152 can include a second projection 102*b* that can be configured in a manner that is similar to the second projection 102 (FIG. 5) that is formed on the first bridge pad 40*a* (FIG. 5).

The bridge 42*b* can be disposed between the first bridge pad 40*b* and the second bridge pad 44*b* and can be necked down relative to the remainder of the detonator bridge 32*b* so as to promote its transition from a solid state to a gaseous or plasma state when an electric current that exceeds a threshold current flows through the detonator bridge 32*b*.

The second bridge pad 44*b* can be constructed with a geometry that is generally similar to the second bridge pad 44 (FIG. 3), except that the second bridge pad 44*b* can be aligned generally perpendicular to the leg portion 152 of the first bridge pad 40*b*. The first and second bridge pads 40*b* and 44*b* can be configured such that a non-conductive zone 154 is formed therebetween so as to ensure that electrical energy is not transmitted directly between the first and second bridge pads 40*b* and 44*b*.

The switch 22*b* can include a source pad 60*b* and a trigger pad 62*b* that can each be unitarily formed from a suitable electric conductor, such as copper, gold, silver and/or alloys thereof, and can be fixedly coupled to or formed onto the base 30 in an appropriate manner, such as chemical or mechanical bonding or metallization. The source pad 60*b* can be positioned relative to the first bridge pad 40*b* to form a gap 70*b* therebetween, while the trigger pad 62*b* can be positioned relative to the first bridge pad 40*b* and the second bridge pad 44*b* to form respective gaps 74*b* and 76*b* therebetween. The source pad 60*b* can include a first projection 100*b* that can be configured in a manner that is similar to the first projection 100 (FIG. 5) that is formed on the source pad 60*a* (FIG. 5). The first and second projections 100*b* and 102*b* cooperate to form an interface I-b that is similar to the interfaces I1-*a* and I2-*a*, described above. The trigger pad 62*b* can include a conductive trigger arm 160 that can extend into the first gap 70*b* between the first projection 100*b* and the second projection 102*b*.

Thus constructed, the detonator 10*b* may be operated in several different ways. For example, standard mode operation may be obtained through use of an external device (i.e., external to the detonator 10*a*) that is capable of switching a source of electrical energy (e.g., electrical source 16 in FIG. 1) with a relatively high voltage to function the exploding foil initiator 20*b*. In this mode, electrical energy can be applied directly across the first and second bridge pads 40*b* and 44*b*.

As another example, the detonator 10*b* may be operated in a breakdown mode wherein a breakdown voltage can be applied to the source pad 60*b* to activate the detonator 10*b*. In this mode, current does not pass through the bridge 42*b* until the voltage that is applied to the source pad 60*b* exceeds that which is needed to cause electrical energy to flow through the interface I-b (e.g., a spark to "jump" the first gap 70*b* that is disposed between the source pad 60*b* and the first bridge pad 40*b*). In the particular example provided, no bias voltage is applied to the first or second bridge pads 40*b* and 44*b* or to the trigger pad 62*b*.

As yet a further example, the detonator 10*b* may be operated in a trigger mode wherein voltage that is less than the breakdown voltage is applied to the source pad 60*b* and a negative biasing voltage is selectively applied to the trigger pad 62*b*. As the voltage that is applied to the source pad 60*b* is less than the breakdown voltage, the exploding foil initiator 20*b* will not operate. Application of the negative biasing voltage to the interface I-b via the conductive trigger arm 160 permits electricity to flow from the source pad 60*b* through the interface I-b to the first bridge pad 40*b* (e.g., a spark jumps the first gap 70*a*) to thereby initiate the flow of electric current through the bridge 42*b*.

While the disclosure has been described in the specification and illustrated in the drawings with reference to various embodiments, it will be understood by those of ordinary skill in the art that various changes may be made and equivalents may be substituted for elements thereof without departing from the scope of the disclosure as defined in the claims. Furthermore, the mixing and matching of features, elements and/or functions between various embodiments is expressly contemplated herein so that one of ordinary skill in the art would appreciate from this disclosure that features, elements and/or functions of one embodiment may be incorporated into another embodiment as appropriate, unless described otherwise, above. Moreover, many modifications may be made to adapt a particular situation or material to the teachings of the disclosure without departing from the essential scope thereof. Therefore, it is intended that the disclosure not be limited to the particular embodiment illustrated by the drawings and described in the specification as the best mode presently contemplated for carrying out this disclosure, but that the disclosure will include any embodiments falling within the foregoing description and the appended claims.

What is claimed is:

1. A device for initiating an energetic material, the device comprising:

a base;

a first electrically conductive pad coupled to the base;

a second electrically conductive pad coupled to the base, the second electrically conductive pad being spaced apart from the first electrically conductive pad by a first gap of a first predetermined distance;

a conductive terminal;

an initiating element coupled between the conductive terminal and the second electrically conductive pad;

a first electrically conductive projection coupled to the first electrically conductive pad and extending into the first gap; and a second electrically conductive projection coupled to the second electrically conductive pad and extending into the first gap, the second electrically conductive projection being spaced apart from the first electrically conductive projection by a second predetermined distance;

wherein the first and second electrically conductive projections form an electrical interface; and wherein no plasma or element adapted to produce a plasma is disposed in the first gap.

2. The device of claim 1, wherein one of the first and second electrically conductive projections includes a plurality of teeth.

3. The device of claim 2, wherein the other one of the first and second electrically conductive projections includes a semi-circular segment.

4. The device of claim 1, further comprising a third electrically conductive pad having a conductive trigger arm that is disposed between the first and second electrically conductive projections.

5. The device of claim 1, wherein the initiating element is an exploding foil initiator.

6. A device for initiating an energetic material, the device comprising:

an initiator having a base, an element pad, an initiating element and a conductive terminal, the element pad being coupled to the base and electrically coupled to the initiating element and the conductive terminal, the element pad having a first projection, the conductive terminal being disposed on a side of the initiating element opposite the element pad; and a switch having a first switch pad that is coupled to the base, the first switch pad having a second projection;

wherein the element pad and the first switch pad are separated by a gap, wherein the first and second projections extend into the gap, and wherein the initiating element is adapted to be activated by electrical energy that is transmitted across the gap; and wherein no plasma or element adapted to produce a plasma is disposed in the gap.

7. The device of claim 6, wherein one of the first and second projections includes a plurality of teeth.

8. The device of claim 7, wherein the other one of the first and second projections includes a semi-circular segment.

9. The device of claim 6, wherein one of the first and second projections includes a semi-circular segment.

10. The device of claim 6, wherein the switch further comprises a second switch pad coupled to the base, the second switch pad including a conductive arm that is disposed in the gap between the first and second projections.

11. The device of claim 6, wherein the initiating element is an exploding foil initiator.

12. A method comprising:

providing a device having a base, first and second electrically conductive pads, an initiating element, a conductive terminal and first and second electrically conductive projections, the first and second electrically conductive pads being mounted on the base, the second electrically conductive pad being spaced apart from the first electrically conductive pad by a first gap of a first predetermined distance, a first end of the initiating element being electrically coupled to the second electrically conductive pad, a second end of the initiating element that is opposite the first end being electrically coupled to the conductive terminal, the first electrically conductive projection coupled to the first electrically conductive pad and extending into the first gap, the second electrically conductive projection coupled to the second electrically conductive pad and extending into the first gap, the second electrically conductive projection being spaced apart from the first electrically conductive projection by a second predetermined distance; and applying electrical energy to at least the first electrically conductive pad to cause at least a portion of the electrical energy to be transmitted between the first and second electrically conductive projections; and wherein no plasma or element adapted to produce a plasma is disposed in the first gap.

13. The method of claim 12, wherein one of the first and second electrically conductive projections includes a plurality of teeth.

14. The device of claim 13, wherein the other one of the first and second electrically conductive projections includes a semi-circular segment.

15. The method of claim 12, wherein one of the first and second electrically conductive projections includes a semi-circular segment.

* * * * *